US005145343A

United States Patent [19]

Belcher

[11] Patent Number: 5,145,343

[45] Date of Patent: Sep. 8, 1992

[54] HELICAL GEAR PUMP AND STATOR WITH CONSTANT RUBBER WALL THICKNESS

[75] Inventor: Ian R. Belcher, Cheshire, United Kingdom

[73] Assignee: Mono Pumps Limited, Audenshaw-Manchester, United Kingdom

[21] Appl. No.: 707,125

[22] Filed: May 31, 1991

[30] Foreign Application Priority Data

May 31, 1990 [GB] United Kingdom ..... 9012134

[51] Int. Cl.[5] ..... F04C 2/107; F04C 5/00

[52] U.S. Cl. ..... 418/48; 418/153; 418/178

[58] Field of Search ..... 418/48, 153, 178

[56] References Cited

U.S. PATENT DOCUMENTS

| | | | |
|---|---|---|---|
| 2,527,673 | 10/1950 | Byram | 418/48 |
| 3,499,389 | 3/1970 | Seeberger et al. | 418/48 |
| 3,612,734 | 10/1971 | Dawson et al. | 418/48 |
| 4,863,359 | 9/1989 | Unterstrasser | 418/48 |
| 4,948,432 | 8/1990 | Leach | 148/2 |

FOREIGN PATENT DOCUMENTS

| | | | |
|---|---|---|---|
| 184938 | 6/1986 | European Pat. Off. . | |
| 209099 | 1/1987 | European Pat. Off. . | |
| 2722623 | 12/1977 | Fed. Rep. of Germany | 418/48 |
| 2713468 | 9/1978 | Fed. Rep. of Germany | 418/48 |
| 3229446 | 2/1984 | Fed. Rep. of Germany | 418/153 |
| 2487017 | 8/1987 | France . | |
| 772971 | 5/1977 | South Africa . | |
| 1181193 | 6/1970 | United Kingdom . | |
| 1235262 | 6/1971 | United Kingdom . | |
| 2184785 | 7/1987 | United Kingdom . | |

*Primary Examiner*—John J. Vrablik

*Attorney, Agent, or Firm*—Fleit, Jacobson, Cohn, Price, Holman & Stern

[57] ABSTRACT

A helical gear pump having a stator in which the wall thickness of the stator is substantially constant. This reduces heating in dry running conditions and this effect can be improved by providing anti-friction surfaces on both the rotor and stator.

5 Claims, 2 Drawing Sheets

HELICAL GEAR PUMP AND STATOR WITH CONSTANT RUBBER WALL THICKNESS

The present invention relates to a helical gear pump and to a stator therefore Helical gear pumps (also known as progressive cavity pumps) comprise a stator formed of an elastomeric material, usually synthetic rubber, comprising a stator body having a female helical gear formation of n starts, defining major and minor diameters, and a rotor rotatable within the female helical gear formation of the stator, the rotor having a male helical gear formation of n±1 starts.

One particular form of stator involves a barrel, which is usually generally cylindrical, and the elastomeric material of the stator is molded into this barrel.

One of the main limitations of the progressive cavity pump design is that it cannot run without the presence of some form of lubrication for an extended period. The lubrication is normally the pumped fluid. For such a pump to operate satisfactorily, there must be an interference fit between the rotor and the stator and the stator must be formed of an elastomeric material. This combination results in a build-up of heat during normal pump operation, due to hysteresis, produced in the elastomer.

As long as the pump is operated within its design parameters, then there is lubrication produced by the fluid being pumped and, the heat build-up remains within acceptable limits. However, from time to time, the pump is caused to run dry due to a failure of the supply of the pumped fluid. The heat generated due to frictional heating of the rubber stator very quickly exceeds acceptable levels, causing the elastomer to revert to its uncured state and to disintegrate.

Typically the time taken for the stator to reach unacceptable levels is two minutes from the onset of dry running. This short time period means that the various protection devices used to detect dry running and to switch off the pump are not entirely reliable, because they have insufficient time in which to react to the dry run condition.

Another limitation of pumps of this conventional nature is that there is a maximum fluid temperature above which the pump cannot operate. If the maximum temperature is exceeded, the stator temperature again reaches unacceptable limits causing stator failure.

It is now proposed, according to the present invention, to provide a helical gear pump stator comprising a stator body having a female helical gear formation thereon defining major and minor diameters, said stator body being formed of an elastomeric material, the wall thickness of the stator body being substantially constant, the surface of the female helical gear formation being subjected to an anti-friction coating. The anti-friction coating may be achieved by chlorination of the synthetic rubber.

It has been found that this obviates many of the difficulties encountered in conventional stator structures. In such conventional structures, the cross-section is repeated along the length of the stator and rotates through 360°, or one pitch, over the length of the stator. The stator thickness varies around the section. This causes varying physical properties around the section and the interference between the rotor and stator is greater at the stator minor diameter than at the stator major diameter, under normal design parameters, to ensure sealing between the rotor and the stator during normal operation.

Experiments on conventional stators show that a maximum temperature occurs at the stator minor diameter and on either side of the minor diameter, the temperature of the stator tends to be different as will be explained in more detail later.

It has been found that with the structure of the present invention, during normal operation, the temperature of the rubber in the constant wall stator is very much lower than for the conventional design.

The design of the present invention in which the wall thickness of the stator is constant and the surface of the helical gear formation is formed with an anti-friction coating largely overcomes these problems insofar as the constant rubber thickness around the stator section means that the physical properties at each position around the section are identical and the interference between the rotor and stator, at the minor diameter, can be reduced as compared with that found with the conventional design. It is believed that this is due to the thinner section of the rubber present at the minor diameter which is stiffer than for the conventional design of stator.

The invention also provides a helical gear pump including a stator according to the invention, the helical gear formation having n starts and a rotor rotatable within said female helical gear formation, the rotor having a cooperating male helical gear formation of n±1 starts, the surface of the rotor having a friction reducing coating, such as a nickel phosphorous coating impregnated with polytetraflorethylene.

In order that the present invention may more readily be understood, the following description is given, merely by way of example, reference being made to the accompanying drawings in which.

Figure 4:
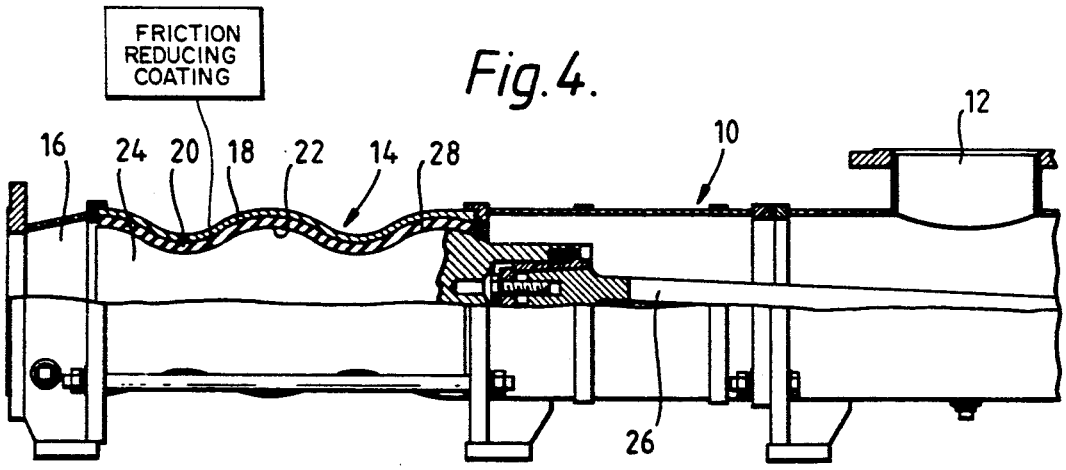
FIG. 4 is a schematic longitudinal cross-section through one embodiment of pump constructed according to the invention.

Referring first to FIG. 4, the helical gear pump illustrated therein comprises a main housing 10 having an inlet 12, the housing having attached to it the helical gear pump itself indicated by the general reference numeral 14, an outlet 16 being provided at the far end.

The pump 14 includes a barrel 18 having molded therein a constant wall thickness stator 20 formed with a female helical gear formation 22 having 2 starts. A rotor 24 is caused to rotate and orbit within the stator by means of a flexible drive shaft 26 passing through the housing 10. The outer surface of the rotor has a male helical gear formation of the same pitch as the gear formation 22 but having a single start.

Further details of the construction of the stator will be given later.

Figure 1:
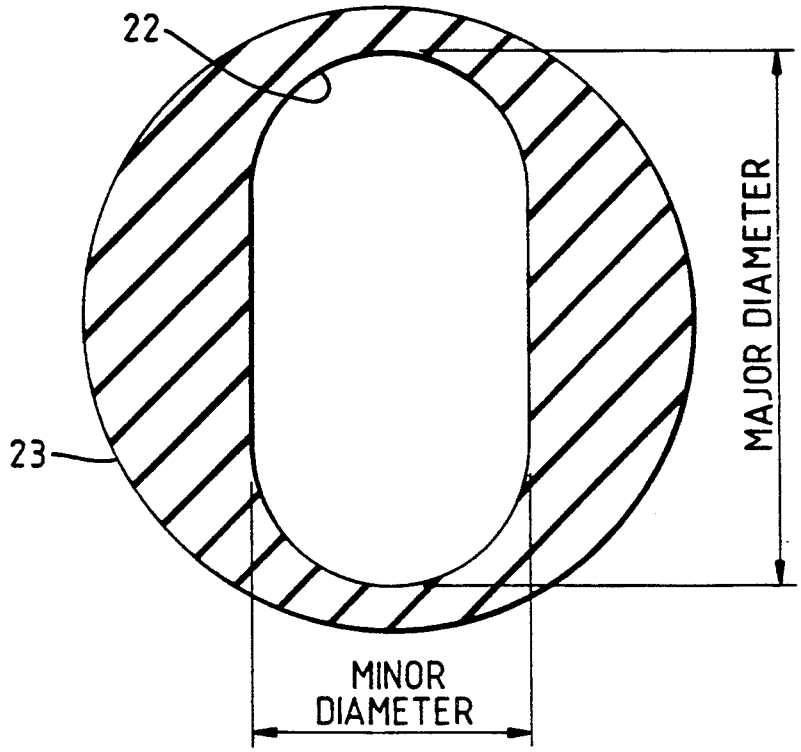
Fig. 1. (PRIOR ART)
FIG. 1 is a cross-section through a conventional design of stator.
Figure 2:
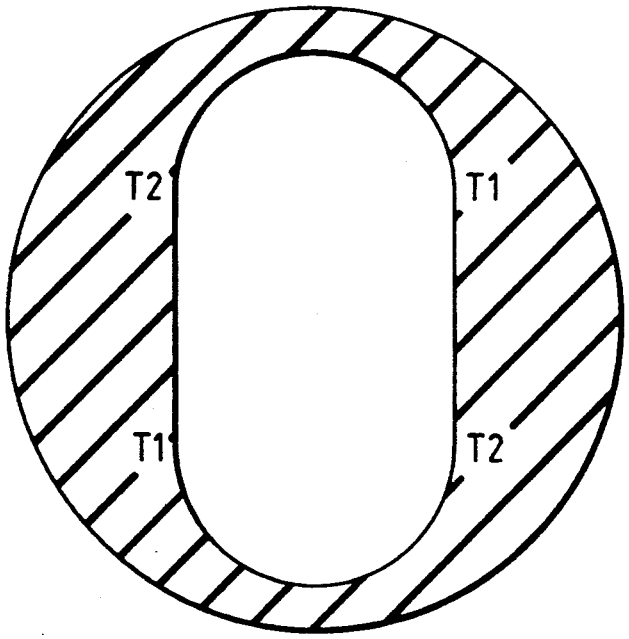
Fig. 2. (PRIOR ART)
FIG. 2 is a view similar to FIG. 1 showing the temperature distribution of such a conventional stator design.

If reference is now made to FIG. 1, there is illustrated therein a conventional stator construction which has the female helical gear formation 22 therein. It will be observed that the outer surface 23 of this stator is circular being located in a barrel (not shown) of cylindrical shape. This produces a varying rubber thickness, the thickness being far greater at the minor diameter than at the major diameter indicated. During normal operation of such a conventional stator pump, a maximum temperature T2 of the stator occurs at the minor diameter, as seen in FIG. 2.

Figure 3:
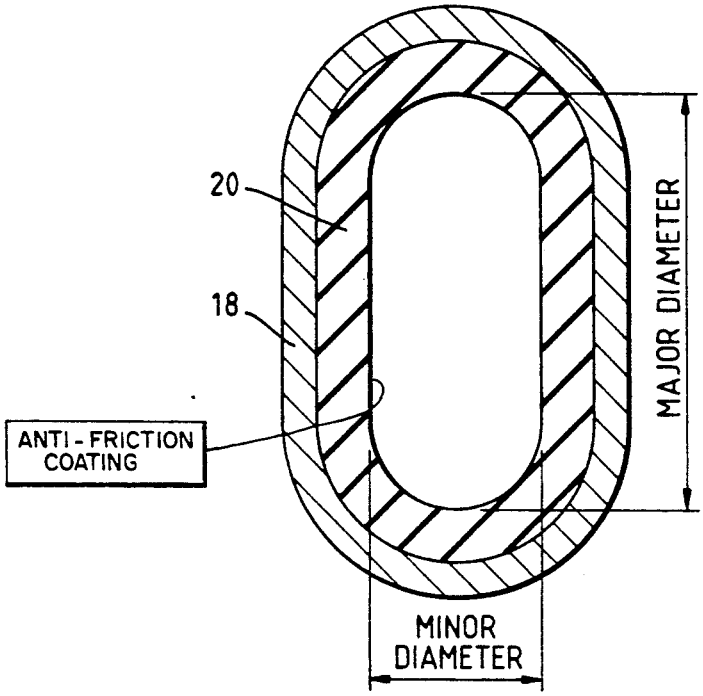
FIG. 3 is a cross-section through one embodiment of stator according to the invention.

It will be noted that on one side of the minor diameter a temperature T1 is illustrated which is slightly lower than the maximum temperature T2 on the other side. This temperature distribution is caused, it is believed, by the mechanism of the rotor rolling along the straight sides of the stator cross-section and forming a bead of rubber along the straight sides of the stator slot. At the location of the temperature T1, the bead of rubber is quite small as the rotor has only traversed a short distance along that side of the slot. By the time it reaches the end of the slot, the bead of rubber will have increased in size having been swept over a longer distance and therefore will generate more heat due to hysteresis effects If one now studies FIG. 3 it will be seen that there is a constant rubber thickness and this is achieved by molding the stator into the barrel 20 which has the same, but a slightly larger, cross-section as the stator core used in the molding process. The constant rubber thickness around the stator section means that the physical properties of the rubber at each position around the cross-section are substantially identical.

The interference between the rotor and the stator, at the minor diameter, can be reduced as compared with that encountered on the conventional stator design. This is due to the thinner section of rubber present at the minor diameter which is stiffer than for the conventional design of stator.

The surface of the rubber may be treated with a friction reducing coating, and this may be achieved, for example, by treating the surface with a chlorination process.

Advantageously, the rotor is provided also with a coating to reduce the friction, such as that sold under the trade name 'Niflor' which is a PTFE impregnated nickel phosphorous. This reduces the frictional co-efficient of the rotor surface.

In using the pump shown in FIG. 4, according to the invention, the temperature of the rubber in the constant wall stator is found to be much lower than for conventional designs of stator. The lower temperature occurs due to the thinner, and hence stiffer, sections of rubber generating less heat due to hysteresis This effect is especially noticeable at the stator minor diameter where there is a significant reduction in temperature as compared with a conventional stator. In addition, the thinner rubber in the constant wall stator of the invention has a reduced insulating effect and hence contributes to the lower stator temperature.

It has been found that during a condition of dry running, the constant wall thickness of the stator produces less heat due to frictional heating for two main reasons. Firstly, there is a reduced interference between the rotor and stator, and secondly, there is a reduced friction between the rotor and stator due to the friction reducing coatings thereon. It has been found that this design is capable of undergoing dry running for a period of as much as 10 minutes without excessive heating of the rubber within the stator.

Basically, therefore, the advantages of the constant wall stator compared to the conventional stator are as follows:

1. Due to the lower rubber temperatures experienced, during normal operation, the constant wall stator can operate at higher speeds and pressures without excessive heating of the rubber in the stator;

2. Due to the improved conduction of heat through the wall of the stator, higher fluid temperatures can be pumped through the stator without excessively heating the rubber in the stator;

3. The constant wall stator can operate under dry run conditions for short periods, typically 10 minutes, without causing excessive heating of the rubber in the stator; and 4. The extended dry run capability of the constant wall stator means that conventional dry run protection devices can be more reliably incorporated into pump designs to detect the onset of dry running and thereby switch the pump off before real damage is done.

I claim:

1. A helical gear pump stator comprising a rigid metal barrel having an inner surface defining a female helical gear formation thereon; a resilient stator body having a corresponding female helical gear formation thereon to that of said barrel and defining major and minor diameters, said stator body being formed of a synthetic rubber and being molded into said metal barrel, effective to produce a substantially constant wall thickness of said synthetic rubber and the surface of said female helical gear formation being subjected to an integrally formed anti-friction coating.

2. A stator as claimed in claim 1, and further comprising a metal barrel having an inner surface corresponding to the female gear formation of the stator, said stator body being molded into said metal barrel, effective to produce the substantially constant wall thickness of said synthetic rubber.

3. A stator as claimed in claim 1, wherein said anti-friction coating comprises a chlorination of the synthetic rubber.

4. A helical gear pump comprising, in combination:

a stator comprising a rigid metal barrel having an inner surface defining a female helical gear formation thereon; a resilient stator body having a corresponding female helical gear formation thereon to that of said barrel and defining major and minor diameters, said stator body being formed of a synthetic rubber and being molded into said metal barrel, effective to produce a substantially constant wall thickness of said synthetic rubber and the surface of said female helical gear formation being subjected to an integrally formed anti-friction coating, said helical gear formation having n starts;

a rotor rotatable within said female helical gear formation;

a cooperating male helical gear formation having $n \pm 1$ starts on said rotor, the male helical gear formation surface of said rotor further comprising a friction reducing coating thereon.

5. A helical gear pump as claimed in claim 4, wherein said friction reducing coating is a nickel phosphorous coating impregnated with polytetraflorethylene.

* * * * *